US009808931B2

(12) United States Patent
Vasquez, III et al.

(10) Patent No.: US 9,808,931 B2
(45) Date of Patent: Nov. 7, 2017

(54) FASTENER AND PLIER ORGANIZER, STORAGE AND CARRY SYSTEM

(71) Applicants: Louis Belman Vasquez, III, Little Rock, AR (US); Louis Belman Vasquez, II, Cleveland, OH (US)

(72) Inventors: Louis Belman Vasquez, III, Little Rock, AR (US); Louis Belman Vasquez, II, Cleveland, OH (US)

( * ) Notice: Subject to any disclaimer, the term of this patent is extended or adjusted under 35 U.S.C. 154(b) by 0 days.

(21) Appl. No.: 14/953,206

(22) Filed: Nov. 27, 2015

(65) Prior Publication Data

US 2016/0167220 A1 Jun. 16, 2016

Related U.S. Application Data

(60) Provisional application No. 62/124,150, filed on Dec. 10, 2014.

(51) Int. Cl.
*B65D 85/28* (2006.01)
*B25H 3/02* (2006.01)

(52) U.S. Cl.
CPC ..... *B25H 3/023* (2013.01)

(58) Field of Classification Search
CPC . B25H 3/00; B25H 3/003; B25H 3/02; B25H 3/023; B25H 3/006
USPC ..... 206/372–375, 376–378, 349
See application file for complete search history.

(56) References Cited

U.S. PATENT DOCUMENTS

| | | | | |
|---|---|---|---|---|
| 4,285,556 | A * | 8/1981 | Loeffel | B25H 3/023 206/372 |
| 8,215,480 | B2 * | 7/2012 | Qian | B01L 9/06 206/363 |
| 8,534,651 | B2 | 9/2013 | Scapa | |
| 8,955,714 | B1 | 2/2015 | Brzon | |
| 2006/0170142 | A1 | 8/2006 | Scapa | |

* cited by examiner

*Primary Examiner* — Jacob K Ackun
*Assistant Examiner* — Rafael Ortiz

(57) ABSTRACT

An inexpensive, portable, durable and convenient organizer, storage and carry system for cleco type and long and short-nosed spring clamp fasteners and pliers that provides enhanced tool accountability in the aerospace industry while working with sheet materials. The present invention also creates workflow efficiencies by allowing for the transportation of multiple sizes and variations of the aforementioned tools in an organized and secure state.

5 Claims, 4 Drawing Sheets

FASTENER AND PLIER ORGANIZER, STORAGE AND CARRY SYSTEM

BACKGROUND OF THE INVENTION

1. Field of the Invention

This invention relates to the organizing, storing, and carrying of CLECO type and spring clamp fasteners and pliers when working with sheet materials such as, but not limited to, aluminum skins, extrusions, formed frames, longerons and stringers used to manufacture or repair aircrafts, space crafts and other aerodynamic vessels.

2. Description of the Prior Art

CLECO type fasteners, pliers and spring clamp fasteners ("the tools") are often used in the aerospace industry to temporarily secure sheet metal parts, such as aluminum, to the fuselage or other components of an aircraft or space craft's outer-covering. These CLECO type and spring clamp fasteners are small objects and are used in large quantities for most manufacturing and repair related procedures. The CLECO type fasteners are available in many sizes, but the four most common are numbered and color-coded as follows: size #40 is silver, size #30 is copper, size #21 is black and size #10 is gold. Spring clamp fasteners have two variations—long-nosed clamp and a short-nosed clamp. Numerous plier types exist, but the most common is the wedgelock plier. All fastener-related pliers function to allow the user to engage the fasteners and temporarily attach them to the materials.

It is important for the user to keep strict controls over all of the tools during use as they have the potential to cause significant damage to the aircraft or spacecraft in flight if left behind. This type of damage is known as Foreign Object Damage ("FOD"), and is a major safety concern that the Federal Aviation Administration (FAA) continues to address.

Currently, the best practice for monitoring or keeping inventory of CLECO type fasteners is by utilizing a portable CLECO type fastener dispenser. Such dispensers can only organize one size of the fasteners per unit and do not address the use of spring clamp fasteners, which are typically used on jobs with CLECO type fasteners, or pliers, which are needed to operate both the CLECO type and spring clamp fasteners. For this reason, a majority of users do not use portable CLECO type fastener dispensers. Instead, they store their various CLECO type and spring clamp fasteners together, co-mingled in zippered bags or toolboxes with pliers. This does not allow the user to quickly take inventory of the tools before, during or after use and increases the likelihood of FOD. Additionally, the user often struggles to maintain organization of the fasteners by size and variation and is slowed by having to laboriously search through bags or compartments to find a size or variation that is suitable.

Ideally, a mechanic needs a lightweight fastener organizer, manufactured at a modest expense, that properly stores and displays the fasteners and pliers for optimal inventory management and thus, diminishes the likelihood of FOD. Therefore, a need exists for such a fastener and plier organizer, storage and carry system to avoid the aforementioned problems.

SUMMARY OF THE INVENTION

The present invention provides a means to store, securely carry and organize CLECO type and spring clamp fasteners and pliers in an efficient manner while working with sheet metal or similar materials. The fastener and plier organizer, storage and carry system is intended to be a relatively inexpensive, lightweight, portable and durable fastener and plier organizer that holds the fasteners so the quantity being secured can easily be ascertained before, during and after the task or duty at hand. The fastener and plier organizer, storage and carry system serves to decrease the likelihood of FOD because the user can take inventory of the tools at a glance and determine that all of the tools are accounted for. Additionally, the fastener and plier organizer, storage and carry system allows the user to carry multiple sizes and variations of CLECO type and spring, clamp fasteners, allowing for workflow efficiencies from one job to another.

The fastener and plier organizer, storage and carry system displays the CLECO type fasteners in a single-level, grid format with the colored tips exposed so they can be readily counted by size. This design is a vast improvement compared to current practices because the amount of time needed to take inventory of the fasteners is dramatically reduced. Also, various sized CLECO type fasteners can be organized and inserted per the user's preference because the method of support for the CLECO type fasteners fits the four major sizes uniformly.

The tools are secured and can be transported without risk of loss because the organizer, storage and carry system is equipped with durable locking mechanisms designed to tightly hold the tools in place until the user disengages the respective locking apparatus. Such locks, eliminate the likelihood of FOD caused by dropping or loosing the tools while traveling to and fro the job site.

The present invention holds significant improvements and serves as a fastener and plier organizer, storage and carry system. These and other features, aspects and advantages of the present invention will become better understood with reference to the following drawings and description.

DESCRIPTION OF THE PREFERRED EMBODIMENTS

The present invention relates to a means to store, securely carry and organize CLECO type and spring clamp fasteners and pliers in an efficient manner while working with sheet metal or other materials when there are securing requirements of two or more pieces. The fastener and plier organizer, storage and carry system is intended to be a relatively inexpensive, lightweight, portable, and durable temporary fastener organizer that holds the temporary fasteners so the quantity of temporary fasteners can easily be ascertained before, during and after they are used by a mechanic or layperson to complete the task or duty at hand. The fastener and plier organizer, storage and carry system serves to increase workflow efficiencies and decrease FOD by lessening the risk of misplacing fasteners and by allowing the user to quickly establish how many fasteners he has so that he can match that quantity to the necessary quantity for project completion.

Figure 1:
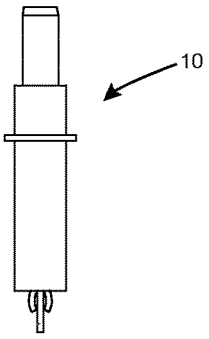
FIG. 1 shows a side elevational view of a CLECO type fastener.

Referring now to FIG. 1, illustrating a side elevational view of a CLECO type fastener 10 according to known prior art.

Figure 2:
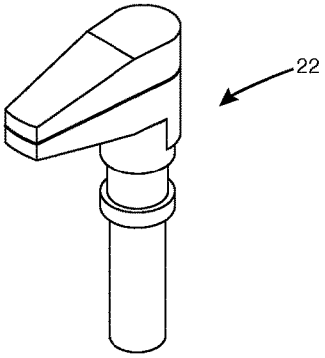
FIG. 2 shows a side elevational view of a long-nosed spring clamp fastener.

Referring now to FIG. 2, illustrating a side elevational view of a long-nosed spring clamp fastener 22 according to known prior art.

Figure 3:
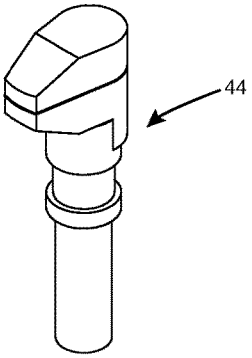
FIG. 3 shows a side elevational view of a short-nosed spring clamp fastener.

Referring now to FIG. 3, illustrating a side elevational view of a short-nosed spring clamp fastener 44 according to known prior art.

Figure 4:
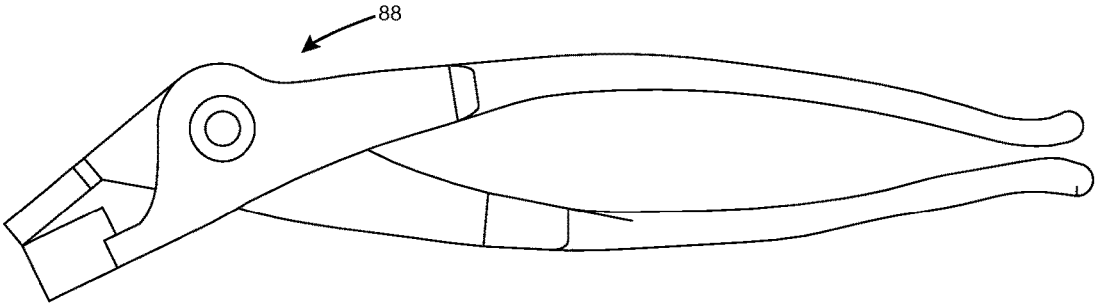
FIG. 4 shows a side view of a wedgelock plier tool.

Referring now to FIG. 4, illustrating a side view of a wedgelock plier tool 88 according to known prior art.

Figure 5:
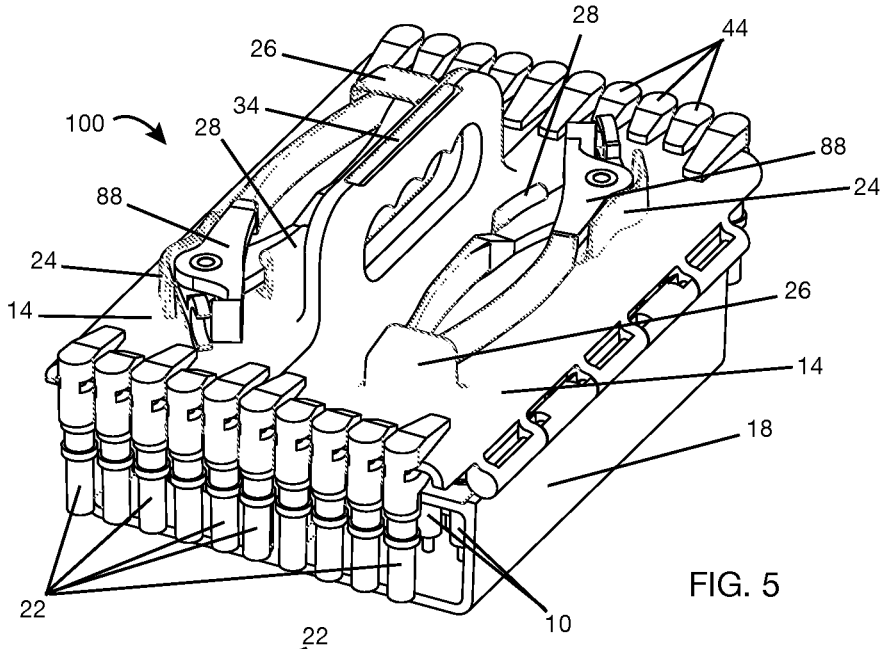
FIG. 5 shows a perspective view of a "loaded" or filled fastener and plier organizer, storage and carry system that is securely closed according to an embodiment of the present invention.

Referring now to FIG. 5, illustrating a perspective view of a "loaded" or filled fastener and plier organizer, storage and carry system 100 that is securely closed according to an embodiment of the present invention. As shown, the fastener and plier organizer, storage and carry system 100 is filled with CLECO type fasteners 10, secures two wedgelock plier tools 88 and can hold an assortment of up to twenty long-nosed spring clamp fasteners 22 and short-nosed spring clamp fasteners 44.

Figure 6:
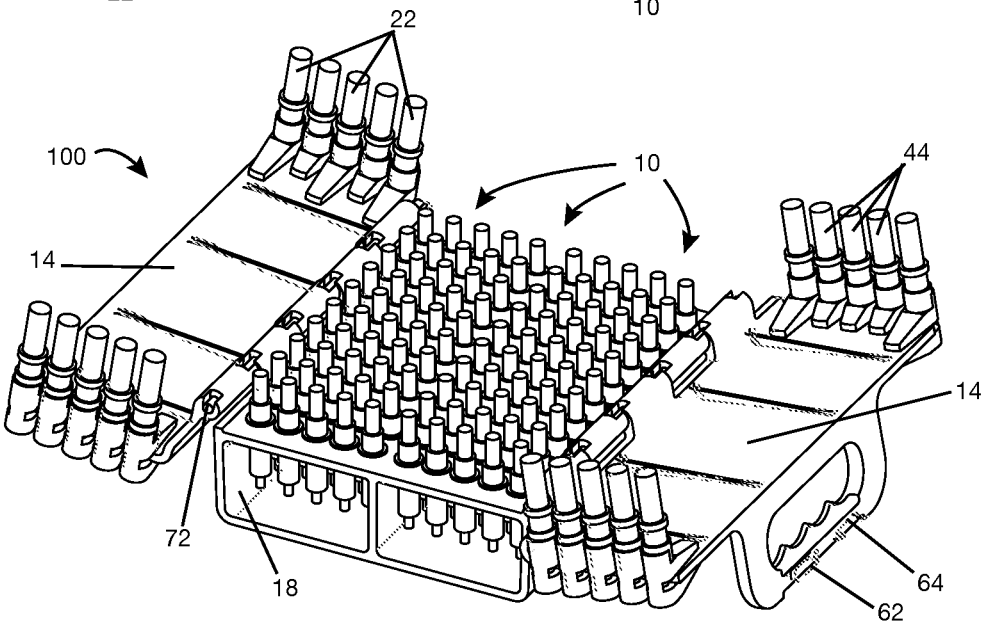
FIG. 6 is a perspective view of a "loaded" or filled fastener and plier organizer, storage and carry system that is open according to an embodiment of the present invention.
Figure 7:
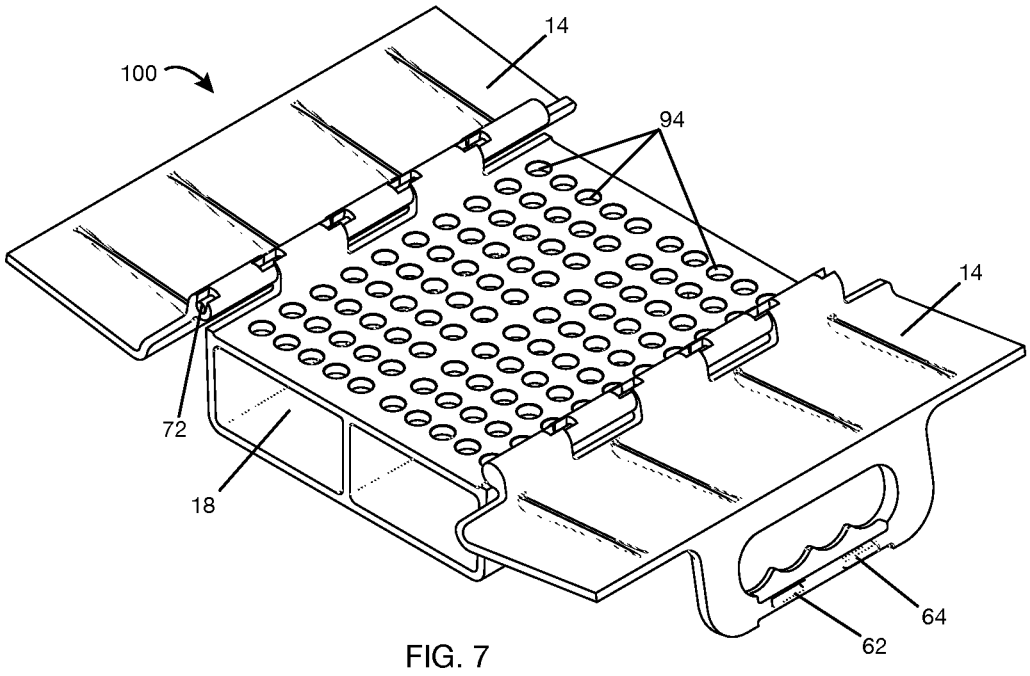
FIG. 7 is a perspective view of the fastener and plier organizer, storage and carry system that is open and empty according to an embodiment of the present invention.

Fastener and plier organizer, storage and carry system 100 comprises two cover pieces 14, each having a holding mechanism 24, 26, and 28 for a wedgelock plier tool 88 and a semi-rectangular divot on the top of the handle 34; bottom tray 18, containing CLECO type fastener 10, apertures 94, as shown in FIG. 7; and two pin hinges 72, as shown in FIG. 6. Fastener and plier organizer, storage and carry system 100 comprises a secure storage and transportation for CLECO type fasteners 10, long-nosed spring clamp fasteners 22, short-nosed spring clamp fasteners 44 and wedgelock plier tools 88 when such devices are required for assembly, repair, or maintenance such as, for example, securing aluminum skins to the frame of an aircraft.

Bottom tray 18 of fastener and plier organizer, storage and carry system 100 comprises a substantially planar surface populated with a distribution of apertures 94 that serve to bold CLECO type fasteners 10. Apertures 94 may range in size to accommodate larger or smaller ClECO type fasteners 10.

When fastener and plier organizer, storage and carry system 100 is loaded or filled completely or partially with temporary fastener(s) 10, 22 and 44 and wedgelock plier tools 88 and the two cover pieces 14 are closed, as shown, the CLECO type fasteners 10 are securely stored in the fastener and plier organizer, storage and carry system 100 due to the male knobs 62 and female receivers 64, shown in FIG. 6 that connect one cover piece 14 to the other, creating a locking effect.

Referring now to FIG. 6, showing a perspective view of a "loaded" or filled fastener and plier organizer, storage and carry system 100 that is open according to an embodiment of the present invention.

CLECO type fasteners 10 will become unsecured or accessible in the fastener and plier organizer, storage and carry system 100 if the user applies pressure to the two semi-rectangular divots 34, as shown in FIG. 5, on the top of the handle of cover pieces 14.

Multiple spring clamp fasteners 22 and 44 are securely attached to the ends of the cover pieces 14 and must be removed by the wedgelock plier tool 88 according to known prior art to be separated from the fastener and plier organizer, storage and carry system.

Referring now to FIG. 7, showing a perspective view of the fastener and plier organizer, storage and carry system 100 that is open and empty according to an embodiment of the present invention.

Figure 10:
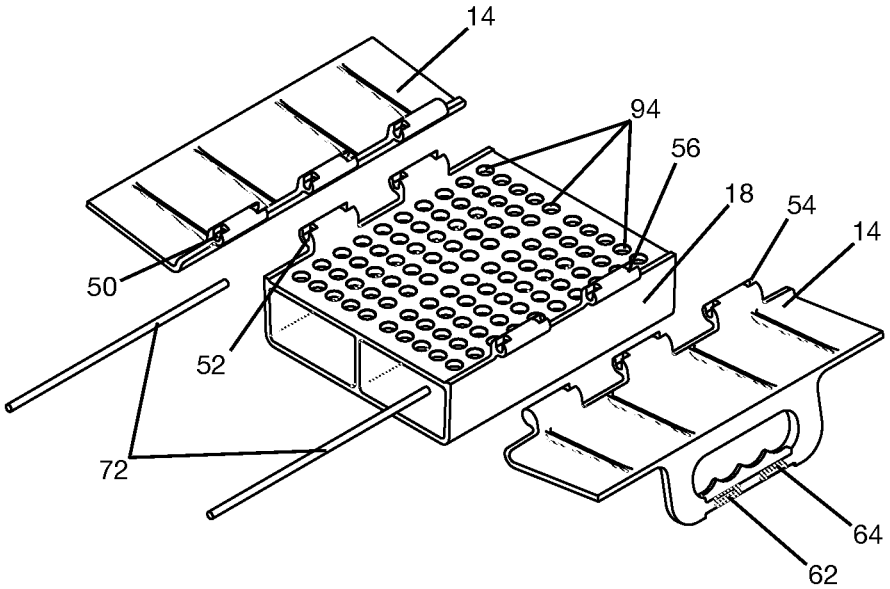
FIG. 10 is a perspective view of the major components of the fastener and plier organizer, storage and carry system when it is not assembled according to an embodiment of the present invention.

Fastener and plier organizer, storage and carry system 100 within the present embodiment comprises material such as a lightweight, durable material such as acrylonitrile butadiene styrene ("ABS") plastic. ABS is an extremely lightweight, durable material that will make lifting the fastener and plier organizer, storage and carry system 100 very easy using only one hand, even if it is "loaded" or filled. In this manner, the present invention is relatively inexpensive to produce and easy to fabricate. Further, ABS is known to be capable of producing living hinges, as present in the current invention represented by pins 72 and hinge holes 50, 52, 54 and 56, as shown in FIG. 10.

Figure 8:
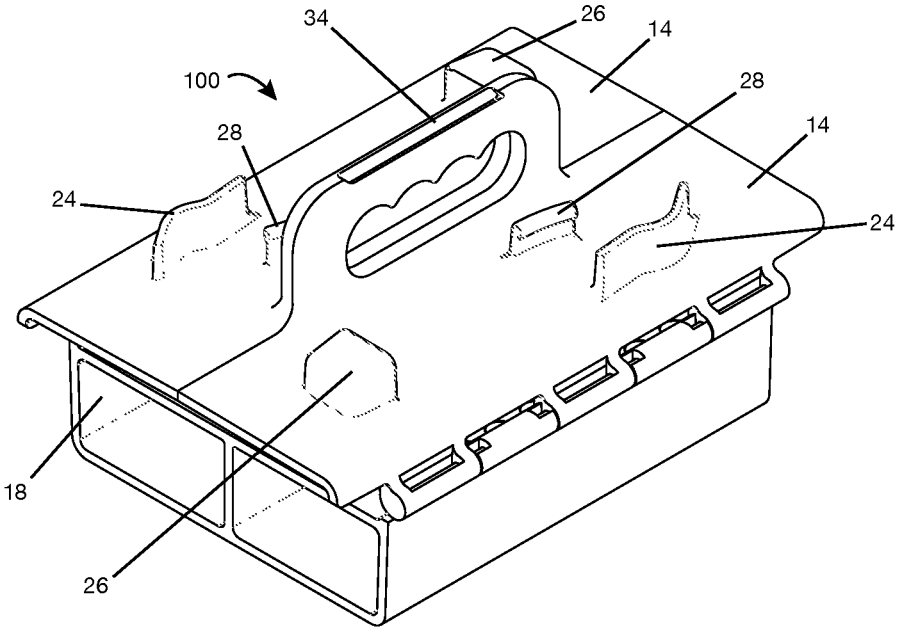
FIG. 8 is a perspective view of the fastener and plier organizer, storage and carry system that is closed and empty according to an embodiment of the present invention.

Referring now to FIG. 8 showing a perspective view of the fastener and plier organizer, storage and carry system 100 empty of fasteners 10, 22 and 44 and wedgelock plier tools 88 with the two cover pieces 14 closed. This figure shows that whether the fastener and plier organizer, storage and carry system 100 is full of CLECO type fasteners 10, as shown in FIG. 5, or is empty, the profile or shape of the invention remains relatively the same.

Figure 9:
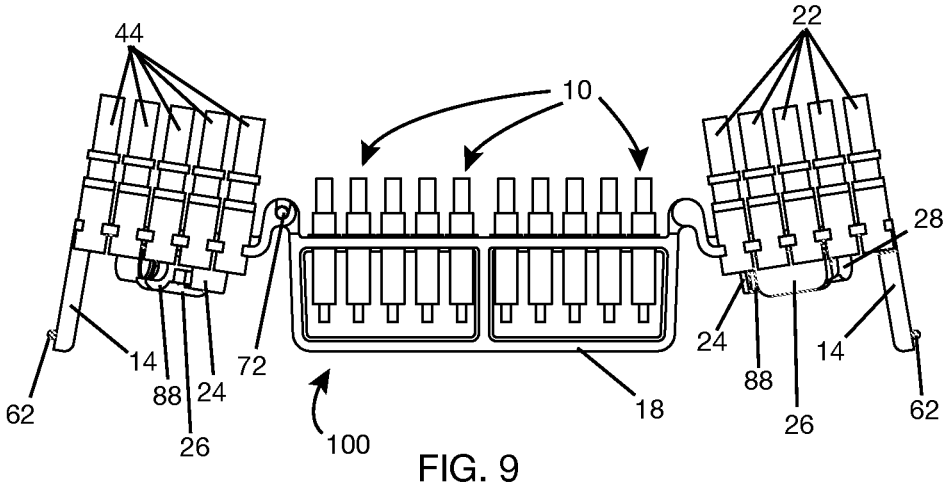
FIG. 9 is a side elevational view of the shorter side of the fastener and plier organizer, storage and carry system that is open and "loaded" according to an embodiment of the present invention.

Referring now to FIG. 9, showing a side elevational view of the shorter side of the fastener and plier organizer, storage and carry system 100 that is open according to an embodiment of the present invention.

To reveal the bottom tray 18 and the apertures 94 that hold the CLECO type fasteners 10, the mechanic separates the two closed cover pieces 14 at least 91 degrees from the starting position (starting position is defined as cover pieces 14 as shown in FIG. 5). The cover pieces 14 are easily opened or closed with one hand because of the motion allowed by pins 72, as shown in FIG. 10.

The wedglock plier tools 88 can remain intact to the upper cover piece 14 in this position even under the force of gravity due to the nature and placement of the holding mechanism 24, 26, and 28, also shown in FIG. 7, that serve to create a holding and locking mechanism for wedgelock plier tool 88. The user can easily snap the wedgelock plier tool 88 in and out of this holding and locking mechanism with one hand. The holding mechanisms 24 and 26 are opposed to each other. The holding mechanism 28 hold and lock a distal portion of the handles of the wedgelock plier tool 88. The wedgelock plier tools 88 are carried by the upper cover piece 14. A second pair of wedgelock plier tools 88 are carried by the other upper cover piece 14, as shown in FIG. 5.

Referring now to FIG. 10, showing a perspective view of the major components of the fastener and plier organizer, storage and carry system 100 when it is not assembled according to an embodiment of the present invention.

The present invention contains three unique pieces, the cover piece 14, the bottom tray 18, and the hinge pin 72. In this manner the present invention is produced inexpensively. To assemble 1 (one) fastener and plier organizer, storage and carry system 100, 2 (two) cover pieces 14, 1 (one) bottom tray 18, and 2 (two) hinge pins 72 are required.

Easy assembly of the fastener and plier organizer, storage and carry system 100 is accomplished by sliding 1 (one) of the hinge pins 72 into the bottom tray 18 on the side of hinge hole 50 while holding hinge hole 52 inline with hinge hole 50, creating a connection between cover piece 14 and bottom tray 18. The same steps for the opposite side, that is, using hinge holes 54 and 56 in the place of hinge holes 50 and 52, respectively will complete assembly of the present invention.

What is claimed is:

1. An apparatus, comprising:

a plurality of first type fasteners;

a plurality of second type fasteners being spring clamp fasteners;

a first wedgelock plier tool;

a bottom tray with a substantially planar surface having a distribution of apertures sized and shaped to hold the plurality of first type fasteners;

first and second upper cover pieces engaged with the bottom tray, wherein the plurality of second type fasteners are engaged with an outer edge of the first upper cover piece;

wherein the first and second upper cover pieces each include a male knob and female receiver;

wherein the first upper cover piece includes a first holding mechanism which frictionally engages a handle of the first wedgelock plier tool; and first and second pin hinges which attach the first and second upper cover pieces, respectively, to the bottom tray.

2. The apparatus of claim 1, wherein the first upper cover piece includes first opposed holding mechanisms which frictionally engage the first wedgelock plier tool.

3. The apparatus of claim 1, further including a second wedgelock plier tool carried by the second upper cover piece.

4. The apparatus of claim 3, wherein the second upper cover piece includes a second holding mechanism which frictionally engages a handle of the second wedgelock pliers.

5. The apparatus of claim 4, wherein the second upper cover piece includes second opposed holding mechanisms which frictionally engage the second wedgelock plier tool.

* * * * *